US006295651B1

(12) United States Patent
Kang

(10) Patent No.: US 6,295,651 B1
(45) Date of Patent: Oct. 2, 2001

(54) UNDERPANTS HAVING PROTECTIVE STRUCTURE

(76) Inventor: Chia-Ming Kang, No. 114, Sec. 1, Hui-Lai Road, Taichung (TW)

( * ) Notice: Subject to any disclaimer, the term of this patent is extended or adjusted under 35 U.S.C. 154(b) by 0 days.

(21) Appl. No.: 09/491,637

(22) Filed: Jan. 27, 2000

(51) Int. Cl.[7] ..... A41B 9/02
(52) U.S. Cl. ..... 2/403; 2/400
(58) Field of Search ..... 2/400–408, 78.1, 2/227, 228, 238, 79, 455, 456, 466, 113, 114, 403; 602/67–73; 604/317, 327, 348–353, 355–358, 385.1, 385.2, 393–396, 386, 387

(56) References Cited

U.S. PATENT DOCUMENTS 3,207,155 * 9/1965 Casey ..... 2/403
3,459,181 * 8/1969 Mann ..... 2/403
4,195,630 * 4/1980 Connery et al. ..... 602/67
4,526,167 * 7/1985 Ebenal et al. ..... 602/70
4,961,419 * 10/1990 Tribble et al. ..... 602/70
5,070,869 * 12/1991 Zhang ..... 602/67
5,226,179 * 7/1993 Choi ..... 2/403
5,283,912 * 2/1994 Chung ..... 2/403
5,290,270 * 3/1994 Fisher ..... 604/387
5,555,568 * 9/1996 Yon ..... 2/403
5,598,587 * 2/1997 Wada ..... 2/403
5,647,065 * 7/1997 Richerson ..... 2/403
5,716,350 * 2/1998 Ryan ..... 604/385.1
5,870,779 * 2/1999 Heron ..... 2/403
5,875,495 * 3/1999 Thrower ..... 2/403
6,038,703 * 3/2000 Chung ..... 2/403

* cited by examiner

*Primary Examiner*—Gloria M. Hale
(74) *Attorney, Agent, or Firm*—Ezra Sutton

(57) ABSTRACT

Underpants having a protective structure are provided with a front piece and a corresponding rear piece which are joined and form underpants. The underpants are further provided with a pocket piece attached to the rear piece so that a pocket space is formed to connect with an opening formed between the front piece and the rear piece. Thus, the wearer's scrotum is received through the opening. A cover piece is attached to the pocket piece by one end and detachably affixed to the front piece by the other end such that the wearer's phallus, passing through the opening, can be held in position between the cover piece and the front piece, thereby preventing discomfort or skin disease due to perspiration from occurring.

5 Claims, 3 Drawing Sheets

UNDERPANTS HAVING PROTECTIVE STRUCTURE

BACKGROUND OF THE INVENTION

1. Field of the Invention

The present invention relates to underpants, and more particularly, to mens' underpants for wearing.

2. Description of Related Art

In general, mens' underpants do not prevent the wearer's scrotum from contacting the groin, which may cause an uncomfortable feeling or even trouble to the wearer.

Therefore, in the U.S. patent application. Ser. No. 09/307,068, U.S. Pat. No. 6,027,517, filed by the inventor of the present invention, mens' underpants are provided to cope with the aforementioned problem of conventional underpants. The mens' underpants of the prior art application include a front piece having a bottom edge, a rear piece having a bottom edge joined with the bottom edge of the front piece to form a bottom sewing line, and a pocket with an opening through the bottom sewing line where a pocket space is adapted to receive the wearer's scrotum.

By means of the pocket, the wearer's scrotum can be kept separate from the wearer's groin, thereby solving the aforementioned problem of groin discomfort. One drawback to the aforementioned mens' underpants, however, is that the wearer's phallus will still be confined between the front piece and the wearer's lower hypogastrium even though the wearer's scrotum has been received within the pocket. Therefore, the phallus is kept in contact with the skin on the wearer's lower hypogastrium. In wearing the underpants, this would then tend to create discomfort or even skin disease due to perspiration. As a result, there exists a need in the underpants, manufacturing industry for new mens' underpants that can help eliminate this drawback.

SUMMARY OF THE INVENTION

It is therefore an objective of this invention to provide underpants having a protection structure which can keep the wearer's phallus separate from the skin on the wearer's hypogastrium, so that the discomfort caused to the wearer by conventional underpants can be eliminated.

In accordance with the foregoing and other objectives, improved underpants are herewith proposed. The underpants of this invention include a front piece made of a fabric and having a bottom edge and a corresponding rear piece made of a fabric and having a bottom edge. The bottom edge of the front piece is joined to that of the rear piece so that an opening is formed subsequent to the completion of the joined portion, allowing the wearer's phallus and scrotum to pass therethrough. After the front and rear pieces have been joined, a pocket piece is attached to the rear piece so that a pocket space is formed and connected to the opening formed between the front piece and the rear piece. The wearer's scrotum which passes through the opening can then be received in the pocket space, thereby preventing the wearer's scrotum from rubbing the wearer's groin. A cover piece also made of a fabric is joined with the upper edge of the pocket piece so that the pocket space as well as the opening are covered by the cover piece after the upper edge of the cover piece is detachably affixed to the front piece at a region above the opening. In this arrangement, when the wearer's phallus passes through the opening it is able to be held in position between the cover piece and the front piece so that it will be kept separate from the wearer's hypogastrium, preventing skin disease due to perspiration or moisture.

In addition, the cover piece and the pocket piece may be integrally formed.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
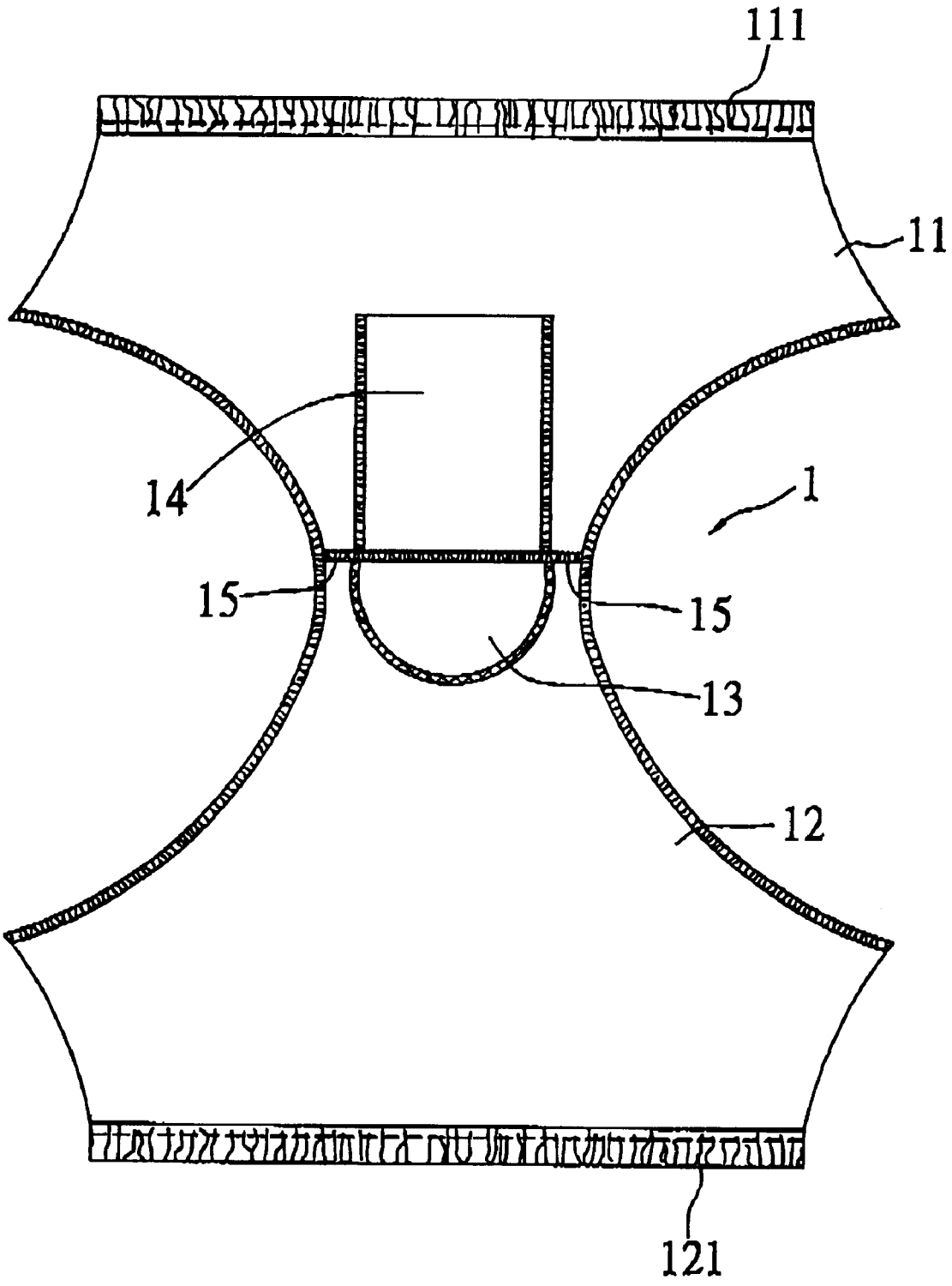
FIG. 1 is a schematic extended diagram of the underpants in accordance with the first embodiment of the invention.
Figure 2:
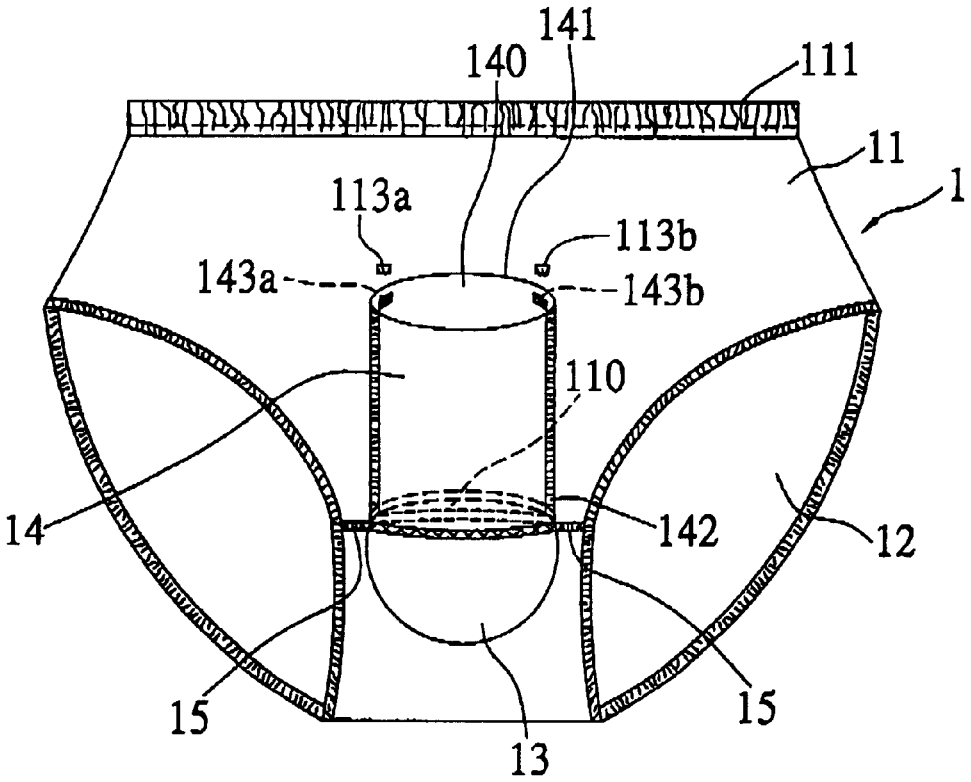
FIG. 2 is a schematic front view of the underpants in accordance with the first embodiment of the invention.

Shown in FIGS. 1 and 2 are the underpants of the first preferred embodiment according to the invention.

Referring now to FIG. 1, the underpants 1 of the first preferred embodiment comprises a front piece 11, a rear piece 12, a pocket piece 13 and a cover piece 14. The front piece 11, rear piece 12, pocket piece 13 and cover piece 14 are all made of a fabric conventionally used for making underpants.

The front piece 11 has a top edge sewn with a stretchable strip 111 and an opposing bottom edge. Similarly, the rear piece 12 has a top edge sewn with a stretchable strip 121 and an opposing bottom edge sewn with the bottom edge of the front piece 11 to form a bottom seam line 15 so that an opening 110 (shown in FIG. 2) is formed in between. In addition, each one of the front piece 11 and the rear piece 12 has two opposing side edges sewn with the side edges of the corresponding piece to become complete underpants that may be worn.

The pocket piece 13 is formed in a bowl shape and sewn to the rear piece 12 so that a pocket space (not designated with a reference numeral) is defined by the rear piece 12 and the pocket piece 13. The pocket space which is connected to the opening 110 allows the wearer's scrotum which passes through the opening 110 to be received in the pocket space of the pocket piece 13. Being received in the pocket space of the pocket piece 13, the wearer's scrotum is thus kept separate from the groin.

The cover piece 14 is formed in a tubular shape and defines a receiving hole 140 which may receive the wearer's phallus. It has an upper end 141 and an opposing lower end 142. The outward edge of the lower end 142 is sewn to the pocket piece 13 and the inward edge of the lower end 142 is sewn to the bottom edge of the front piece 11 so that the opening 110 and the pocket space of the pocket piece 13 are connected to the receiving hole 140 of the cover piece 14, allowing the wearer's phallus to pass through the opening 110 and be received in the receiving hole 140 of the cover piece 14. When the wearer's phallus is received in the cover piece 14, it can be kept separate from the skin on the hypogastrium and thus skin disease or discomfort due to the frequent contact of the phallus with the skin on the hypogastrium can be eliminated.

Furthermore, the upper end 141 of the cover piece 14 is detachably affixed to the front piece 11 at a predetermined position above the opening 110, by the engagement of a pair of male, hook fasteners of a set of hook and loop (VELCRO) fasteners 143*a,* 143*b* attached to the inner surface of the cover piece 14 near the upper end 141 with a pair of corresponding female, loop fasteners of a hook and loop fastener set, VELCRO fasteners 113*a,* 113*b* attached to the front piece 11, as shown in FIG. 2. It should be noted that other kinds of conventional fastening means such as press studs are applicable. Therefore, to pass urine the wearer of the underpants simply has to detach the upper end 141 of the cover piece 14 from the front piece 11.

Figure 3:
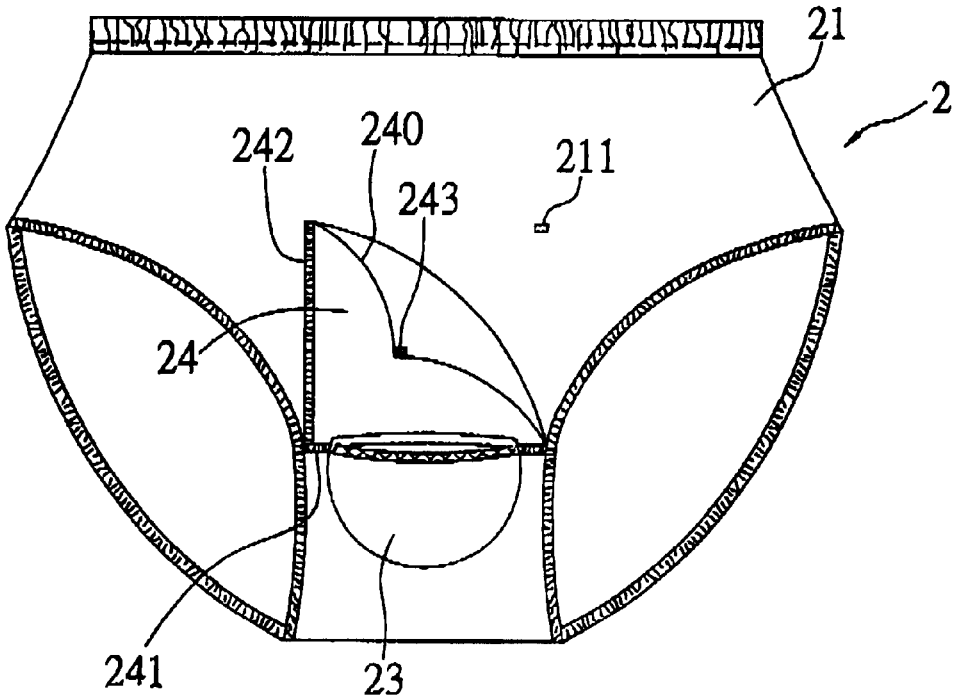
FIG. 3 is a schematic front view of the underpants in accordance with the second embodiment of the invention.

FIG. 3 illustrates the structure of the underpants of the second embodiment according to the invention.

As shown in. FIG. 3, underpants 2 of the second embodiment are structurally similar to the previous embodiment except for the cover piece. The cover piece 24 of the second embodiment is in a rectangular shape and has an upper edge 240 and an opposing lower edge 241. The lower edge 241 of the cover piece 24 is sewn with the pocket piece 23 and the bottom sewing line (not designated with a reference numeral for the purposes of simplification). A side edge 242 of the cover piece 24 is sewn to the front piece 21 to hold the cover piece 24 in position with respect to the front piece 21. Meanwhile a male or hook fastener of a hook and loop fastener set or VELCRO fastener 243 is attached to the inner surface of the cover piece 24 so as to be engaged with a corresponding female or loop fastener of a hook and loop fastener set or VELCRO fastener 211 attached to the front piece 21, allowing the cover piece 24 to be partly detached from the front piece 21 when the wearer passes urine.

Figure 4:
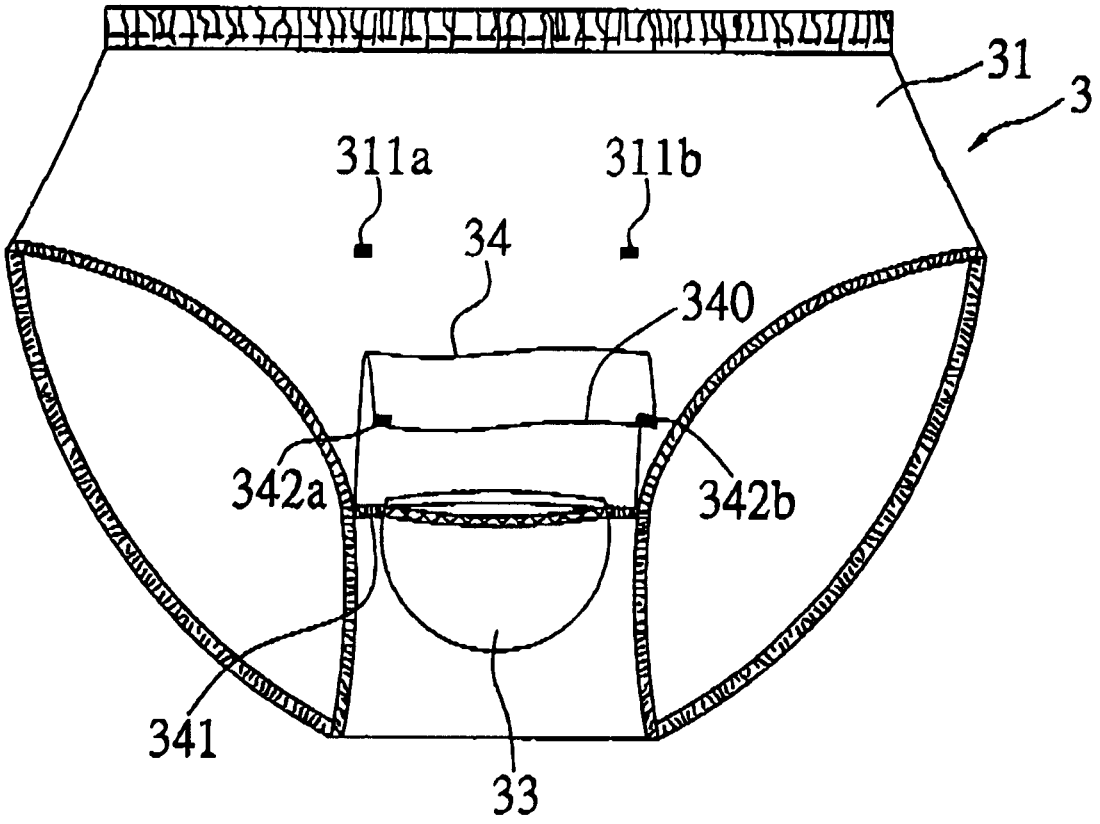
FIG. 4 is a schematic front view of the underpants in accordance with the third embodiment of the invention.

FIG. 4 is a schematic front view of the underpants of the third preferred embodiment.

Underpants 3 of the third embodiment are structurally similar to the previous embodiments except for the cover piece. The cover piece 34 of the underpants 3 is also in a rectangular shape and has an upper end 340 and an opposing lower end 341. The lower end 341 is sewn to the bottom sewing line and the pocket piece 33 while the upper end 340 is attached by a pair of male velcro fasteners 342*a,* 342*b* for engagement with a pair of corresponding female velcro fasteners 311*a,* 311*b* on the front piece 31.

The invention has been described using exemplary preferred embodiments. However, it is to be understood that the scope of the invention is not limited to the disclosed embodiments. On the contrary, it is intended to cover various modifications and similar arrangements.

What is claimed is:

1. Underpants having a protection structure, which comprise:

a) a front piece having a bottom edge;

b) a rear piece having a bottom edge joined with said bottom edge of said front piece to form a bottom sewing line with an opening formed within said sewing line for a wearer's phallus and scrotum to pass therethrough from inside of the underpants;

c) a pocket piece attached to said rear piece to form a pocket space connected to said opening for receiving the wearer's scrotum passing through said opening and;

d) a cover piece having a lower end and an opposing upper end, said lower end of said cover piece being attached to said pocket piece and said upper end of said cover piece being detachably affixed to said front piece, allowing the wearer's phallus to be held in position between said front piece and said cover piece after passing through said opening.

2. The underpants of claim 1, wherein the cover piece is of a tubular shape which defines a receptacle for receiving a wearer's phallus.

3. The underpants of claim 1, wherein the cover piece is in a rectangular shape.

4. The underpants of claim 1, wherein the front piece, the rear piece, the cover piece, and the pocket piece are made of a fabric.

5. The underpants of claim 1, wherein the upper end of the cover piece is detachable affixed to the front piece by fastening means.

* * * * *